United States Patent [19]

No et al.

[11] Patent Number: 4,777,103

[45] Date of Patent: Oct. 11, 1988

[54] ELECTROPHOTOGRAPHIC MULTI-LAYERED PHOTOSENSITIVE MEMBER HAVING A TOP PROTECTIVE LAYER OF HYDROGENATED AMORPHOUS SILICON CARBIDE AND METHOD FOR FABRICATING THE SAME

[75] Inventors: Hiroshi No; Shin Araki, both of Yokohama; Hideki Kamaji, Kawasaki; Kohei Kiyota, Tokyo, all of Japan

[73] Assignee: Fujitsu Limited, Kanagawa, Japan

[21] Appl. No.: 923,556

[22] Filed: Oct. 27, 1986

[30] Foreign Application Priority Data

Oct. 30, 1985 [JP] Japan ..... 60-244796
Jun. 13, 1986 [JP] Japan ..... 61-137500

[51] Int. Cl.[4] ..... G03G 5/14
[52] U.S. Cl. ..... 430/66; 430/128
[58] Field of Search ..... 430/66, 67, 128

[56] References Cited

U.S. PATENT DOCUMENTS 4,365,013 12/1982 Ishioka et al. ..... 430/66
4,394,425 7/1983 Shimizu et al. ..... 430/66
4,452,874 6/1984 Ogawa et al. ..... 430/57

FOREIGN PATENT DOCUMENTS 3209055 10/1982 Fed. Rep. of Germany .
3307573 9/1983 Fed. Rep. of Germany .
3418596 11/1984 Fed. Rep. of Germany .

*Primary Examiner*—John L. Goodrow
*Attorney, Agent, or Firm*—Armstrong, Nikaido, Marmelstein & Kubovcik

[57] ABSTRACT

An electrophotographic multi-layered photosensitive member having a top layer of hydrogenated amorphous silicon carbide and the method for forming the top layer are provided. The hydrogenated amorphous silicon carbide has an atomic ratio of carbon to carbon plus silicon C/(Si+C) ranging from 0.17 to 0.47 and a ratio of the number of hydrogen atoms bonded to a silicon atom per silicon atom, to number of hydrogen atoms bonded to a carbon atom per carbon atom, {(Si—H)-/Si}/{(C—H)/C}, ranging from 0.3 to 1.0. The top layer is formed on a photosensitive member of hydrogenated amorphous silicon by employing a glow discharge CVD method. The gaseous mixture composed of disilane ($Si_2H_6$) and propane ($C_3H_8$) mixed with a mol ratio expressed as $C_3H_8/(Si_2H_6+C_3H_8)$ ranging from 0.2 to 0.6 is used. Another gaseous mixture is also used with an improved result. The mixture comprises disilane ($Si_2H_6$) gas, propane ($C_3H_8$) gas, and hydrogen ($H_2$) gas, the mixing mol ratio of the propane gas to the disilane gas expressed as $C_3H_8/(Si_2H_6+C_3H_8)$ ranging from 02 to 0.7, and the mixing mol ratio of the hydrogen gas to the remaining gas, $H_2/(Si_2H_6+C_3H_8)$, ranging from 1 to 10.

9 Claims, 5 Drawing Sheets

ELECTROPHOTOGRAPHIC MULTI-LAYERED PHOTOSENSITIVE MEMBER HAVING A TOP PROTECTIVE LAYER OF HYDROGENATED AMORPHOUS SILICON CARBIDE AND METHOD FOR FABRICATING THE SAME

BACKGROUND OF THE INVENTION

The present invention relates to an electrophotographic printing apparatus. More particularly, it relates to a multilayered photosensitive member of doped amorphous silicon formed on a printing drum. It further relates to a top or outer layer made of hydrogenated amorphous silicon carbide formed atop of the photosensitive member for protecting the member. It still further relates to the method for fabricating the top layer.

Electrophotography is a well-known technology, and electrophotographic printing apparatuses are widely used in the field. The apparatus has a photosensitive member disposed on the surface of a printing drum. In the first process step of the electrophotographic printing method, the photosensitive member is charged to a uniform potential to sensitize it using an electrostatic charger such as a corona discharger. The charged portion of the photosensitive surface is exposed to a light image of an original document which is to be reproduced. This records an electrostatic latent image on the photosensitive member corresponding to the original document. Thereafter, the latent image is developed by bringing a developing material such as a toner powder into contact therewith. In this way, a powder image is formed on the surface of the photosensitive member which is to be transferred onto a recording sheet. Thereafter, the powder image is permanently affixed to the recording sheet in the image configuration. Finally, at the next cleaning station, residual toner particles are removed from the surface of the photosensitive member. This is a typical cycle of the conventional electrophotographic printing process, taking approximately 20 seconds or so for a standard level apparatus, and several seconds for a high speed apparatus.

The photosensitive member of the printing drum described above consists of photosensitive, chargeable materials such as selenium or chalcogenide glasses (arsenic-selenium alloys and compounds). It is also known to utilize organic photosensitive materials therefor. Recently, however, amorphous silicon has become widely used, as for example, that disclosed in U.S. Pat. No. 4,507,375, issued on Mar. 26, 1985.

The requirements for devices of an electrophotographic printing apparatus are as follows. The material of the surface layer of the photosensitive member of the printing apparatus, which is formed on a printing drum, must have a high photosensitivity in the spectral range of the employed light source, such as a laser source. The material must also have a specific electrical impedance in darkness (dark resistance) of a magnitude greater than $10^{12}$ Ω cm, in order to substantially retain an electrostatic latent image thereon during at least one cycle of the printing operation, approximately 20 seconds as described above. The material must also have properties which remain unaltered with a continuous loading and unloading, i.e. which operates in a fatigue-proof manner and which is sufficiently resistant to abrasion during the printing operation, to various environmental hazards such as high humidity and to damages caused by the corona discharge. It is difficult to satisfy these requirements with a single photoconductive layer. For example, a photosensitive material having a high dark resistance and a high light conductance at the same time, is rarely found.

In order to fulfill these requirements described above, therefore, a multi-layered photosensitive member of amorphous silicon has been developed, being a well-known technology. One example is disclosed in U.S. Pat. No. 4,452,874 issued on June 5, 1984 to Ogawa et al. An amorphous layer II (top layer) of amorphous silicon carbide layer containing silicon atoms, carbon atoms, and hydrogen atoms, is disclosed therein, being accompanied with a method for forming the layer by electrically decomposing a gaseous mixture of hydrogenated silicon gases and hydrocarbon gases. A gas mixture of silane ($SiH_4$) and methane ($CH_4$) typically is used.

FIG. 1 is a schematic partial cross-sectional view of a multi-layered photosensitive member. On a cylindrical drum base 1 of conductive material such as aluminum, a charge blocking layer 2 of highly p-type doped hydrogenated amorphous silicon (a-Si:H) is formed by a conventional method such as a glow discharge CVD (chemical vapor deposition) method for decomposing and depositing gaseous mixture of silane ($SiH_4$) and diborane ($B_2H_6$) with electrical energy.

Over the charge blocking layer 2, a photoconductive layer 3 of slightly p-type doped hydrogenated amorphous silicon (a-Si:H) is formed by the same CVD method employing the similar gaseous mixture with a different gas ratio from the one of the preceding case. The photoconductive layer 3 has high electrical conductance under exposure to light (light conductance) but not so high dark resistance.

Thereafter, a top layer 4 is formed on the photoconductive layer 3 for not only protecting the surface thereof from various environmental hazards but also for retaining the charges of the electrostatic latent image formed thereon and for preventing the latent image from being dispersed and weakened. The top layer 4 is formed of a photosensitive material having a high dark resistance such as hydrogenated amorphous silicon oxide (a-SiO:H), hydrogenated amorphous silicon nitride (a-SiN:H), or hydrogenated amorphous silicon carbide (a-SiC:H). The top layer 4 has also high abrasion resistive properties sufficient to protect the surface from exterior mechanical damage during the operation.

The charge blocking layer 2 has a rectifying characteristics due to the difference of doping density between the charge blocking layer 2 and the photoconductive layer 3. Consequently, the injection of electrical carriers from the drum base 1 into the photosensitive member under dark condition is blocked and excess charges generated in the photoconductive layer 3 under exposure of light is allowed to flow from the photoconductive layer 3 to the drum base 1. Thus, by the aid of the charge blocking layer 2 and the top layer 4, the entire surface of photosensitive member has high dark resistance, being immune from any image flow or image weakening.

Among the above-described requirements for a photosensitive member formed on a printing drum, the following are characteristic of the top layer 4: a charge retaining capability for maintaining charges of a latent image recorded therein; resistance to deterioration when exposed to a corona discharge during the charging process, and resistance to abrasion and moisture caused by the exterior environment. However, these requirements have not been satisfied with a prior art top layer, causing some problems with the electrophotographic printing apparatus. The problems may be attributed to some defects in the top layer 4, such as small pin holes. Such defects of the top layer 4 are considered to be caused by some defective structure in the material of the layer 4.

Generally, the structural defects, namely, local distortion of the silicon network, of the amorphous silicon or amorphous silicon compounds such as amorphous silicon carbide, are caused by the presence of dangling bonds, that is, non-terminated bonds of silicon atoms. For example, in intrinsic amorphous silicon (a-Si), the distribution density of the dangling bonds is approximately $10^{20}$ $cm^{-3}$. In hydrogenated amorphous silicon, three non-terminated bonds are intended to be bonded to hydrogen atoms (H). It is reported that the density of the dangling bond can be reduced to approximately $10^{15}$ $cm^{-3}$ with an adequate fabricating method. However, the hydrogen atoms tend to be bonded to silicon or other atoms non-uniformly.

Particularly, in hydrogenated amorphous silicon compounds such as hydrogenated amorphous silicon carbide, hydrogen atoms are attracted and bonded to carbon atoms. The uniform distribution of bonded hydrogen atoms is desirable for reducing the structural defects in amorphous silicon compound material. Thus, a material having fewer dangling bonds therein and a method for fabricating the material are keys to improving the photosensitive member of the printing drum, and the solution of the above described problems.

Various efforts have been directed to solve the above problems regarding a top layer for an electrophotographic photosensitive member. The quality and the production efficiency depends on the combination and composition of the foregoing gas mixture. In a view to further improvement, namely, in order to achieve faster film formation rate and more resistance against the damage of the surface of the substrate (hereby, a photoconductive layer 3) caused by a glow discharge plasma during glow discharge CVD process, a new gaseous mixture and the resulting hydrogenated amorphous silicon carbide layer has been studied.

In the above description, a glow discharge CVD method is introduced for the formation of a photosensitive member. Other conventional methods, such as a sputtering method, and a laser assisted CVD method, are available for the same purpose. However, in the following, the glow discharge method will be described. The selection of the methods will depend on the quantity of production, variety of products, and investment for installed facilities.

SUMMARY OF THE INVENTION

It is an object of the present invention to provide a multi-layered photosensitive member for a printing drum of an electrophotographic printing apparatus with an improved top layer having substantial resistance to damage from environmental factors and a high electrical impedance.

It is a further object of the present invention to provide suitable material for the top layer.

It is still further an object of the present invention to provide the method for fabricating an improved top layer.

It is the ultimate object of the present invention to provide a reliable and high quality electrophotographic printing apparatus capable of reproducing a clear information image.

The problems arising in a prior art electrophotographic printing apparatus described before are successfully solved by a proposed multi-layered photosensitive member by the present invention. FIG. 2 is a partial cross-sectional view of the photosensitive member according to the present invention. In comparison with the prior art one illustrated in FIG. 1, a newly improved top layer 11 is employed.

As described before, hydrogenated amorphous silicon carbide (a-SiC:H) has been utilized as a material for a top layer of a photosensitive member formed on a printing drum. According to the present invention, the composition of the material is selected and formed employing a suitable fabricating method in order to reduce defects contained in the top material, and achieve a more effective and reliable fabrication method.

The hydrogenated amorphous silicon carbide used for the top layer 11 has an atomic ratio of carbon to carbon plus silicon C/(Si+C) ranging from 0.17 to 0.47 and a ratio of the number of hydrogen atoms bonded to a silicon atom, per silicon atom to the number of hydrogen atoms bonded to a carbon atom per carbon atom, {(Si—H)/Si}/{(C—H)/C}, ranging from 0.3 to 1.0 The top layer 11 is formed on a photoconductive layer 3 of $p^-$ type doped hydrogenated amorphous silicon (a-Si:H) which is formed on a drum base 1 over a blocking layer 2.

These layers are deposited employing a well-known glow discharge CVD method. However, the gaseous mixture to be decomposed is improved. Unlike the foregoing referred case of Ogawa et al, more chemically active disilane ($Si_2H_6$) is used as a hydrogenated silicon gas to achieve a higher film formation rate and a lower discharging power, which results in less plasma damage to the associated substrate surface. In combination with disilane gas, propane ($C_3H_8$) gas is selected as the most suitable hydrocarbon gas. The mixing gas ratio of both gases is determined by a number of experiments. Thus, the top layer 11 is deposited from a gaseous mixture composed of disilane ($Si_2H_6$) and propane $C_3H_8$) mixed with a mol ratio $C_3H_8/(Si_2H_6+C_3H_8)$ ranging from 0.2 to 0.6. As a result, a satisfactory top layer 11 is obtained, having a sufficiently small number of defects to fulfill the above described requirements for an electrophotographic printing apparatus.

As a further improved method for forming the top layer, another gaseous mixture comprising disilane ($Si_2H_6$) gas, propane ($C_3H_8$) gas, and hydrogen gas, the mixing mol ratio of the propane gas to the disilane gas $C_3H_8/(Si_2H_6+C_3H_8)$ ranging from 0.2 to 0.7, and the mixing mol ratio of the hydrogen gas to the remained gas, $H_2/(Si_2H_6+C_3H_8)$ , ranging from 1 to 10, is employed.

The quality of the top layer, namely, number of structural defects thereof, depends on the method for forming the top layer, particularly, on the gas mixing ratio of the gaseous mixture of component gases.

The details and advantages will be apparent from the following embodiments and claims, referring to the following drawings wherein like reference numerals designate like parts.

DESCRIPTION OF PREFERRED EMBODIMENTS

Figure 1:
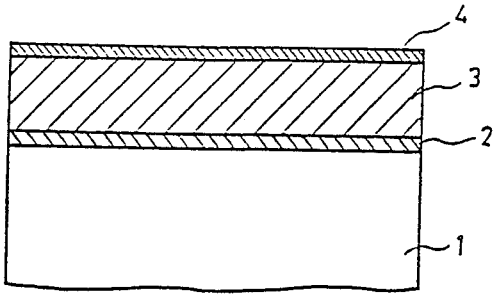
FIG. 1 PRIOR ART
FIG. 1 is a partial cross-sectional view of a prior art photosensitive member formed on a printing drum of an electrophotographic apparatus.
Figure 2:
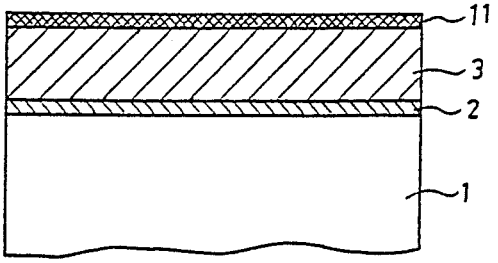
FIG. 2 is a partial cross-sectional view of a photosensitive member of a printing drum of an electrophotographic apparatus according to the present invention.

FIG. 2 is a partial cross-sectional view of the first embodiment, a photosensitive member of a printing drum of an electrophotographic printing apparatus. The top layer 11 is formed over a photoconductive layer 3 of slightly opened p-type hydrogenated amorphous silicon (a-Si:H) which is formed over a drum base 1 on a blocking layer 2. By the present invention, the top layer 11 is newly improved.

The hydrogenated amorphous silicon carbide used for the top layer 11 has an atomic ratio of carbon to carbon plus silicon C/(Si+C), in the range between 0.17 to 0.47, and an atomic ratio of the number of hydrogen atoms bonded to a silicon atom per silicon atom to the number of hydrogen atoms bonded to a carbon atom per carbon atom, {(Si—H)/Si}/{(C—H)/C}, ranging from 0.3 to 1.0. The quality of the hydrogenated amorphous silicon carbide layer substantially depends on the method for forming the layer. The forming method will be described.

Figure 3:
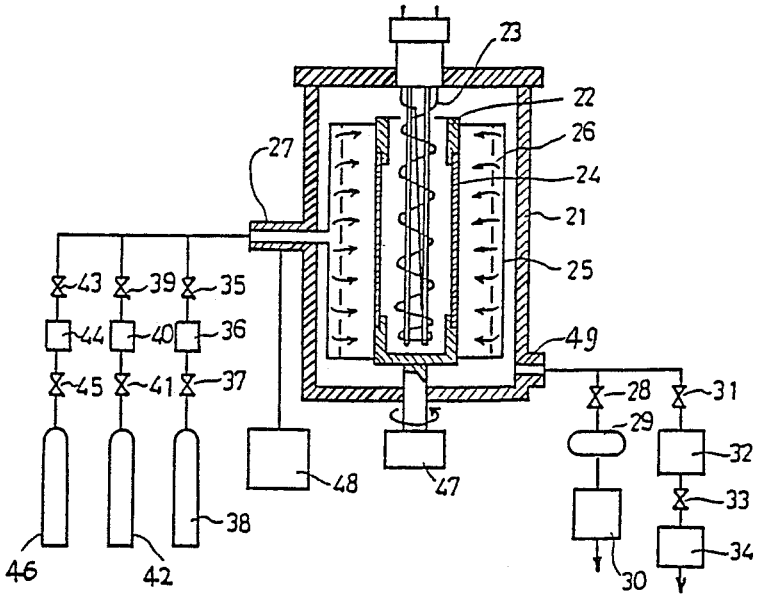
FIG. 3 is a schematic cross-sectional view of a glow discharge CVD apparatus for the first embodiment, illustrating a CVD chamber and its associated gas feeding and exhausting system.

FIG. 3 is a schematic cross-sectional view of a glow discharge CVD apparatus, illustrating a CVD chamber and its associated gas feeding and exhausting system. Within a vacuum tight chamber 21, heating means 23 comprising sheathed heaters arranged in a cylindrical plane, a rotatable holder 22 being driven by a driving means 47, a gas ejecting cylinder 26 having ejecting holes opened therein, and a cylindrical discharge electrode 25 are arranged co-axially in the recited order outward from the center. The whole chamber is exhausted using an exhausting means drawing through an exhausting tube 49, and is fed with reaction gasses through a gas feeding tube 27 connected to a gas feeding system.

First, a cylindrical drum base 24 is set co-axially on the holder 22. A vacuum valve 28 is opened and the chamber 21 is preevacuated by a mechanical booster pump 29 and a rotary pump 30 to a vacuum of approximately $1\times10^{-3}$ Torr, or sufficient to reach a back pressure of an oil diffusion pump 32, then the vacuum valve 33 is opened, vacuum a back pressure of an oil diffusion pump 32, then the vacuum valve 28 is closed, and the vacuum valve 31 is opened. The chamber 21 is evacuated to a high vacuum of approximately $1\times10^{-6}$ Torr by the aid of a rotary pump 34 and an oil diffusion pump 32. After evacuating the residual air or gases within the chamber 21, the vacuum valves 31 and 33 are closed and the evacuation operation is switched back to the former vacuum circuit comprising mechanical booster pump 29 by opening the vacuum valve 28.

The drum base 24 is rotated by the driving means 46, and preheated to between 150° and 350° C., preferably up to 200° to 300° C., by the heating means 23 positioned inside the drum base 24. Thereafter, gas valves 35, 37, 39 and 41 are opened, allowing disilane gas ($Si_2H_6$) and diborane gas ($B_2H_6$) to flow in from respective cylinders 38 and 42. The flow rate of each gas is controlled by mass flow controllers 36 and 40 respectively. The mixing ratio of diborane ($B_2H_6$) to disilane ($Si_2H_6$) is selected to be between 100 and 1000 ppm. The vacuum valve is adjusted to maintain the gas pressure inside the chamber 24 between 0.005 and 5.000 Torr, preferably between 0.1 and 3.0 Torr. In this state, a current, supplied from a power source 48, having high frequency, such as 13.56 MHz, and power density of 5 to 500 $mW.cm^{-2}$, preferably 10 to 200 $mW.cm^{-2}$, is applied between the discharge electrode 25 and the drum base 24 to generate a glow discharge therebetween. Consequently, the gaseous mixture is decomposed by the glow discharge, and a charge blocking layer 2 is deposited on the surface of the drum base 24. The resulting layer 2 is of p+ doped, hydrogenated amorphous silicon layer having a thickness of 0.01 to 1.00 μm.

At the next step, in the same manner, a photoconductive layer 3 of slightly p-type doped hydrogenated amorphous silicon layer having a high light conductance and a thickness of 5 to 30 μm, is deposited from a gaseous mixture having a ratio of diborane ($B_2H_6$) to disilane ($Si_2H_6$) ranging from 1.0 to 10 ppm.

Thereafter, gas valves 35, 37, 39 and 41 are closed and disilane ($Si_2H_6$) cylinder 38 and diborane ($B_2H_6$) cylinder are disconnected from the chamber 21, and the evacuation system is operated to evacuate the chamber 21. Then, the gas valves 35, 37, 43 and 45 are opened and disilane ($Si_2H_6$) gas and propane ($C_3H_8$) gas are supplied from respective cylinders 38 and 46, and controlled by mass flow controllers 36 and 44 respectively to form a gaseous mixture having a mixing ratio $C_3H_8/(Si_2H_6+C_3H_8)$ of 0.2 to 0.6. The pressure of the gaseous mixture is kept between 0.1 to 3.0 Torr. In the same manner as for formation of the former layers, a top layer 11, a hydrogenated amorphous silicon carbide (a-SiC:H) layer of 0.01 to 1.0 μm in thickness is formed over the photoconductive layer 3. Thus, the photosensitive member of the printing drum is completed.

The structural, optical and electrical properties of hydrogenated amorphous silicon carbide (a-SiC:H) which is formed by a glow discharge CVD method, are dependent upon the composition of the gaseous mixtures containing carbon and silicon sources and on the decomposition conditions. These properties of the layer formed according to the present invention, are studied and examined.

Figure 4:
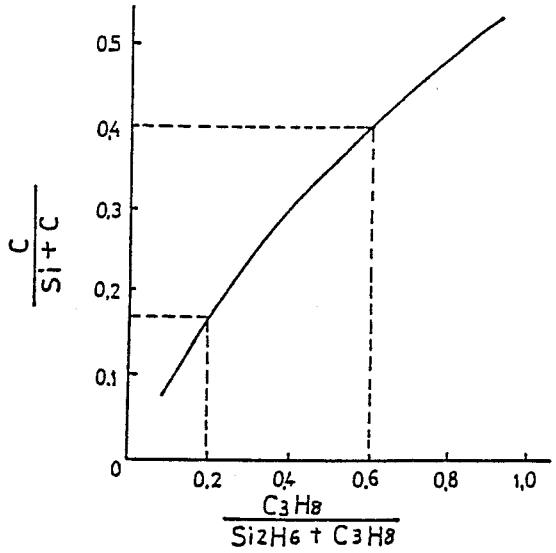
FIG. 4 is a diagram illustrating the relation between atomic ratio of carbon to silicon of hydrogenated amorphous silicon carbide (a-SiC:H) layer of the first embodiment formed by a glow discharge CVD method, and gas ratio of gaseous mixture of disilane and propane used thereby.

The atomic ratio of carbon atoms to silicon atoms, is measured with a hydrogenated amorphous silicon carbide layer deposited from a gaseous mixture of disilane ($Si_2H_6$) and propane ($C_3H_8$). The gas mixing ratio is varied over a range, and is controlled by mass flow controllers. The atomic ratio of a formed layer is determined by an electron spectroscopy for chemical analysis (ESCA) method or X-ray photo-emission spectroscopy (XPS). The number of hydrogen atoms bonded to a silicon or carbon atom is measured by a conventional Fourier transform infrared adsorption spectroscopy (FT-IR). The result is plotted in a diagram of FIG. 4. The gas mixing ratio (mol ratio) of $C_3H_8/(Si_2H_6+C_3H_8)$ is taken on the abscissa, and the atomic ratio of C/(Si+C) is plotted on the ordinate. As shown in the diagram, the range of gas mixing ratio range from 0.2 to 0.6, corresponds to the range of the atomic ratio from 0.17 to 0.40. This atomic range is favorable for the electrical and environmental characteristics of the top layer 11 as described later.

Figure 5:
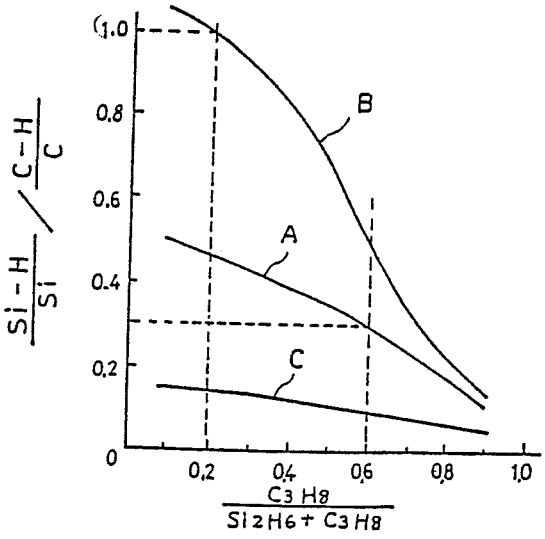
FIG. 5 is a diagram illustrating the relation between the ratio of hydrogen atoms bonded to a silicon atom to those bonded to a silicon atom in the hydrogenated amorphous silicon carbide a-SiC:H) layer of the first embodiment and the gas ratio of gaseous mixture of disilane and propane used for the formation of the layer.

Generally, in a hydrogenated amorphous silicon carbide layer, hydrogen atoms tend to be bonded to carbon atoms forming $CH_2$, $CH_3$ and $CH_4$ bonds, and leaving silicon atoms in the non-bonded state, namely, dangling bond states. This is undesirable to reduce the structural defects of the hydrogenated amorphous silicon carbide. FIG. 5 is a diagram illustrating the relation between atomic ratio of hydrogen atoms bonded to a silicon atom per silicon atom to those bonded to a carbon atom per carbon atom in the formed hydrogenated amorphous silicon carbide (S-SiC:H) layer and gas ratio of gaseous mixture of disilane ($Si_2H_6$) and propane ($C_3H_8$). The number of hydrogen atoms bonded to a silicon or carbon atom is measured by a conventional FT-IR. The glow discharge conditions of the CVD process are as follows. A frequency of glow discharge high frequency power is as commonly used and fixed at 13.56 MHz and flow rate of the gaseous mixture is fixed also at 15 SCCM (standard cubic centimeter per minute). For curve A, the other glow discharge conditions, namely, the total gas pressure of the discharge gas is 3 Torr, and the discharge power is 200 W. For curve B, the discharge conditions are 1 Torr and 30 W respectively. As can be seen from FIG. 5, the atomic ratio of hydrogen atoms bonded to a silicon atom per silicon atom to those bonded to a carbon atom per carbon atom falls in the range of 0.3 to 1.0, corresponding to the gas mixing ratio of 0.2 to 0.6. Curve C is taken for reference with hydrogenated amorphous silicon carbide layer formed with a prior art technology employing a gaseous mixture of silane ($SiH_4$) gas and methane ($CH_4$) gas. As seen from curve C, the atomic ratio of hydrogen atoms bonded to a silicon atom per silicon atom to those bonded to a carbon atom per carbon atom falls below 0.2. As a result, in the prior rate layer, there are less hydrogen atoms bonded to silicon atoms, namely a larger number of dangling bonds of silicon atoms than that of the present invention. These curves A, B, and C imply that the hydrogenated amorphous silicon carbide layer according to the present invention contains far fewer dangling bonds than those of the layer formed by the prior art method.

Figure 6:
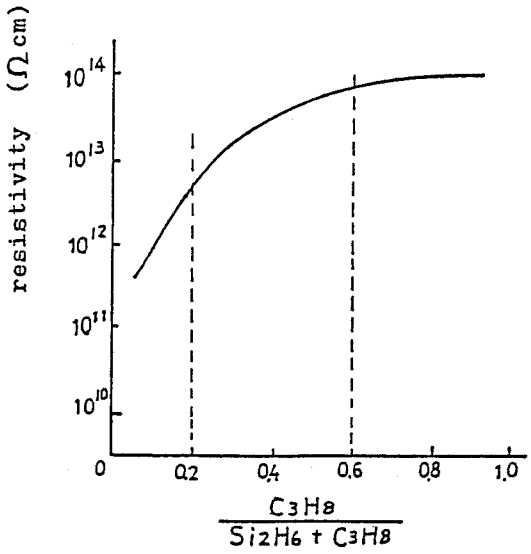
FIG. 6 is a diagram illustrating the relation between dark resistance of the formed hydrogenated amorphous silicon carbide layer of the first (and second) embodiment and mixing ratio of propane to disilane of gaseous mixture used for glow discharge CVD process.

To verify the above the resistance characteristics of a hydrogenated amorphous silicon carbide layer formed according to the present invention are measured. FIG. 6 is a diagram wherein dark resisitivity of the layer is plotted on the ordinate against mixing ratio of propane to disilane of the associated gaseous mixture used for glow discharge CVD process. The achieved resisitivity is higher than $10^{12}$ Ωcm, sufficient to maintain a high charged potential on the surface of the top layer. The empirically obtained curve indicates that the gas mixing ratio ranging from 0.2 to 0.6 is suitable for obtaining a top layer capable of sustaining a clear electrostatic image on the photosensitive layer.

Figure 7:
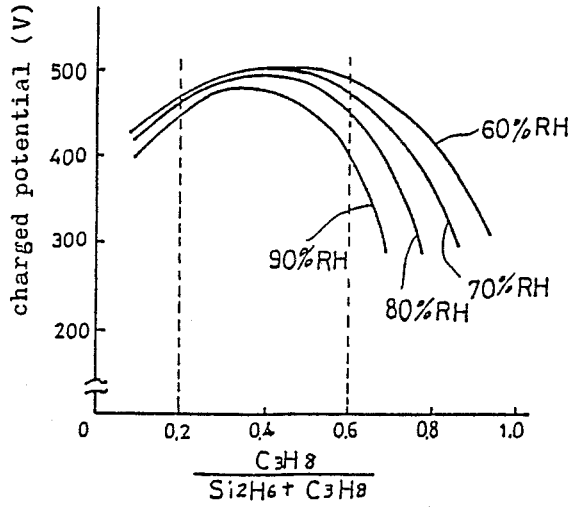
FIG. 7 is a diagram illustrating the empirical results of moisture durability with respect to the first embodiment. On the abscissa, mixing gas ratio of propane ($C_3H_8$) to disilane ($Si_2H_6$) is taken, and charged potential of the surface of the associated specimen is plotted on the ordinate.

Reduction of the number of dangling bonds or structural defects in a top layer will serve to increase moisture stability of the surface, resulting in maintaining the charged potential applied to the surface of the layer which is exposed to a high moisture. The moisture stability of a top layer formed of hydrogenated amorphous silicon carbide according to the present invention, is empirically studied with a number of specimens. FIG. 7 is a diagram illustrating the empirical results of the moisture stability. On the abscissa, mixing gas ratio of propane ($C_3H_8$) to disilane ($Si_2H_6$) is taken, and charged potential of the surface of the associated specimen is plotted on the ordinate. For every curve, relevant relative humidity to which the specimens are exposed, are given as parameters. Each specimen is kept in a moist environment of designated relative humidity, at room temperature of 35° C., for approximately 2 hours, and later that the surface potential is measured after charging up with the application of corona charge discharged by a voltage of 5.5 Kv. The resulting charged potential over 400 V is obtained for the most severe environmental condition of 90% relative humidity with respect to the gas mixing ratio ranging from 0.2 to 0.6. As shown in FIG. 7, however, gas mixing ratios higher than approximately 0.6, result in substantially poor moisture stability of the layer. In contrast, a prior art top layer, although is not shown in FIG. 7, has such poor moisture durability that the top layer kept in a moist environment of 70% to 80% relative humidity shows a remarkable drop of charged potential by 50% or more.

As described before, the capability of keeping high charged potential of the surface of a top layer of a photosensitive member serves to achieve a clear reproduced recorded image having high OD (optical density). In view of this, a practical experiment is performed with photosensitive members having top layers of hydrogenated amorphous silicon carbide formed by the method according to the present invention. The quality evaluation of the photosensitive members are conducted by practical printing operation employing a document printer, a type M3071A, manufactured by FUJITSU LIMITED. The top layer of hydrogenated amorphous silicon carbide for each specimen is prepared from a gaseous mixture of propane and disilane using various mixing ratios. The experiments are performed under environments of various relative humidity, and the results are evaluated and tabulated in Table 1 for each gas mixing ratio. The last column, there is tabulated, a sample No. 10, an experimental result with respect to a prior art top layer deposited from a gaseous mixture of silane and methane. The evaluations are classified in four groups, namely, excellent, denoted by a double circle, fairly good, denoted by a circle, good, denoted by a triangle, and unacceptable, denoted by a cross. The standard of the classification is as follows:

| classification | chargeable potential | minimum exposure energy for printing | optical density |
|---|---|---|---|
| excellent | >480V | <3.0 $\mu J\ cm^{-2}$ | >1.2 |
| fairly good | >450 | <3.5 | >1.0 |
| good | >400 | <4.0 | >0.8 |
| unacceptable | <400 | >4.0 | <0.8 |

An initial charged potential is provided by a corona discharger with charging voltage of 5.5 Kv, and the wave length of irradiating light to the photosensitive member is 780 nm.

When gaseous mixtures containing less propane gase are used, the resulting hydrogenated amorphous silicon carbide layer contains fewer carbon atoms, and the amorphous silicon carbide layer begins to have characteristics similar to that of intrinsic hydrogenated amorphous silicon, namely, lower dark resistivity from which arises problems such as image flow or ambiguous reproduction of the printed image.

Thus, it is concluded that a gas mixing ratio ranging from 0.2 to 0.6, most preferably, 0.3 to 0.5 is the best selection for glow discharge CVD to form a hydrogenated amorphous silicon carbide top layer.

TABLE 1

| sample No. | 1 | 2 | 3 | 4 | 5 | 6 | 7 | 8 | 9 | 10 |
|---|---|---|---|---|---|---|---|---|---|---|
| gas mixing ratio | 0.1 | 0.2 | 0.3 | 0.4 | 0.5 | 0.6 | 0.7 | 0.8 | 0.9 | |
| printing quality | | | | | | | | | | |
| 40% RH | Δ | ○ | ◎ | ◎ | ◎ | ◎ | ○ | Δ | X | ◎ |
| 50% RH | Δ | ○ | ◎ | ◎ | ◎ | ◎ | ○ | Δ | X | ○ |
| 60% RH | Δ | ○ | ◎ | ◎ | ◎ | ◎ | ○ | Δ | X | Δ |
| 70% RH | Δ | ○ | ◎ | ◎ | ◎ | ○ | Δ | X | X | X |
| 80% RH | Δ | ○ | ◎ | ◎ | ○ | Δ | X | X | X | X |
| 90% RH | X | Δ | ○ | ○ | ○ | Δ | X | X | X | X |

The second embodiment of the present invention of the method for forming a top layer of hydrogenated amorphouse silicon carbide, is a modified version of the first embodiment. Briefly speaking, hydrogen gas is added to the gaseous mixture for glow discharge CVD for forming the above layer. Some of hydrogen gas molecules in a glow discharge field are activated to radical hydrogen atoms which react with amorphous silicon carbide and bond to silicon atoms, serving to reduce dangling bonds of the silicon atoms.

Figure 8:
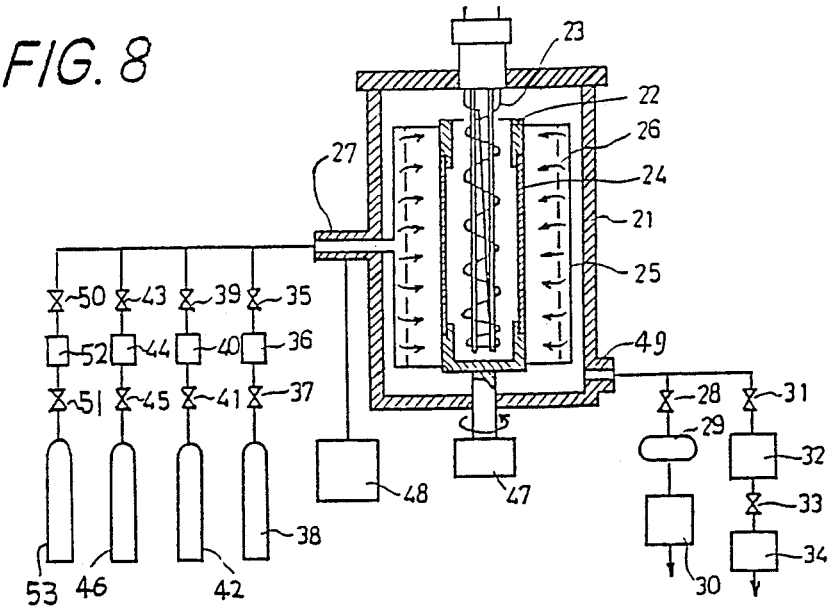
FIG. 8 is a schematic cross-sectional view of a glow discharge CVD apparatus for a second embodiment, illustrating a CVD chamber and its associated gas feeding and exhausting system.

FIG. 8 is a schematic cross-sectional view of a glow discharge CVD apparatus employed for the second embodiment, illustrating a CVD chamber and its associated gas feeding and exhausting system. The apparatus illustrated in FIG. 8 is almost similar to that of FIG. 3, except the addition of a hydrogen gas feeding system comprising two gas valves 50 and 51, a mass flow controller 52, and a hydrogen cylinder 53. As shown in FIG. 8, the hydrogen gas feeding system is connected to a vacuum chamber 21 in parallel with systems of the other depositing gases. Gaseous mixture for glow discharge CVD is composed of propane,, disilane, and hydrogen. The mixing ratio of propane to disilane, $C_3H_8/(Si_2H_6+C_3H_8)$is selected to range from 0.2 to 0.7, and the mixing ratio of hydrogen to propane plus disilane, $H_2/(Si_2H_6+C_3H_8)$ is selected to range from 1 to 10. Other conditions, such as the pressure of the gaseous mixutre, and the high frequency power density for glow discharge, are the same as those of the first embodiment. Furthermore, the hydrogen gas feeding system is connected or disconnected to the vacuum tight chamber 21 in the similar manner to the feeding of propane and disilane gases and at the same processing step. Further description of handling of the apparatus of FIG. 8, therefore, will be not necessary.

Figure 9:
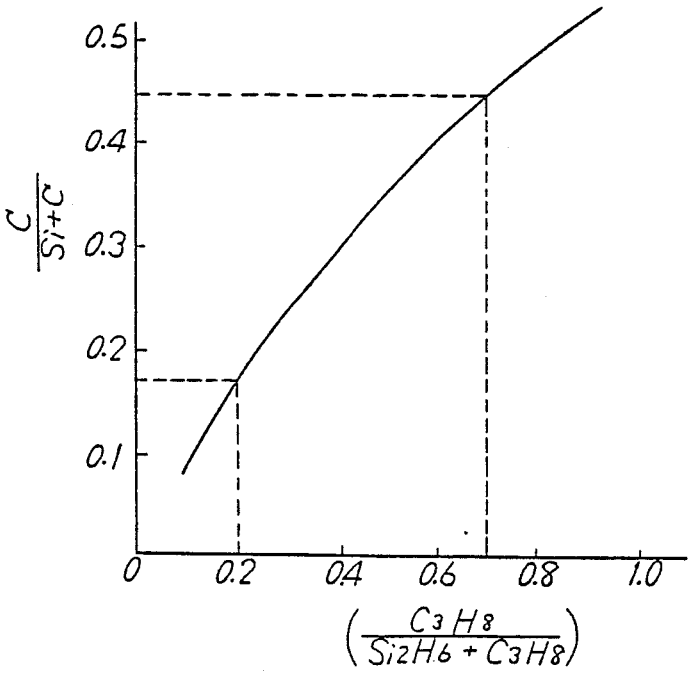
FIG. 9 is a diagram illustrating the relation between atomic ratio of carbon to silicon of the hydrogenated amorphous silicon carbide (a-SiC:H) layer of the second embodiment, formed by a glow discharge CVD method, and gas ratio of gaseous mixture of disilane and propane used thereby.

Atomic ratios of carbon atoms to silicon atoms are meaured with produced hydrogenated amorphous silicon carbide layers formed by the method of the second embodiment with respect to a range of gas mixing ratio. The results are plotted in a diagram of FIG. 9. The gas mixing mol ratio of $C_3H_8/(Si_2H_6+C_3H_8)$ is taken on the abscissa, and the atomic ratio of C/(Si +C) is plotted on the ordinate. As shown in the diagram, the gas ratio range from 0.2 to 0.7 corresponds to the range of the atomic ratio from 0.17 to 0.45. This atomic range is favorable for the electrical and environmental characteristics of the top layer 11 as described above. The mixing ratio of hydrogen ranging from 1 to 15 does not significantly affect the atomic ratio of the layer. The characteristic of FIG. 9 is almost the same as that of FIG. 4.

Figure 10:
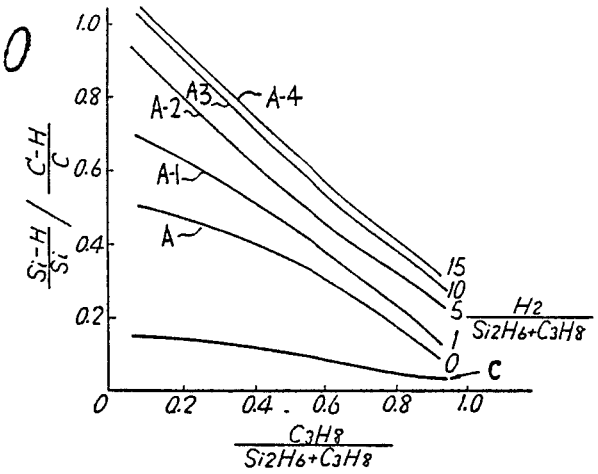
FIG. 10 is a diagram illustrating the relation between the ratio of hydrogen atoms bonded to a silicon atom to those bonded to a silicon atom in the hydrogenated amorphous silicon carbide (a-SiC:H) layer of the second embodiment and gas ratio of gaseous mixture of disilane and propane.

FIG. 10 is a diagram illystrating the relationship between the atomic ratio of hydrogen atoms bonded to silicon atoms per silicon atom to those bonded to carbon atoms per carbon atom in the formed top layer and the gas ratio of gaseous mixture of disilane ($Si_2H_6$) and propane ($C_3H_8$). The frequency of glow discharge high frequency power of the CVD process is fixed at 13.56 MHz and flow rate of the gaseous mixture is 15 SCCM. The total gas pressure of the discharge gas is 3 Torr, and the discharge power is 200 W. For curve A, the glow discharge gas mixture contains no hydrogen gas, and for curves A-1, A-2, A-3 and A-4, the hydrogen mixing ratios are respectively, 1, 5, 10 and 15. As can be seen from FIG. 10, the atomic ratio of hydrogen atoms bonded to a silicon atom per silicon atom to those bonded to a carbon atom per carbon atom increases as the hydrogen content in the gaseous mixture increases. With respect to mixing ratio (mol ratio) of propane, $C_3H_8/(Si_2H_6+C_3H_8)\leqq 0.7$, and gas mixing ratio (mol ratio) of hydrogen $H_2/(Si_2H_6+C_3H_8)\geqq 1$, the atomic ratio of hydrogen atoms bonded to a silicon atom per silicon atom to those bonded to a carbon atom per carbon atom, falls on the range exceeding 0.3, where hydrogen atoms are bonded to carbon and silicon atoms almsot uniformly and the layer contains little structural defects. However, with the content of hydrogen $H_2/(Si_2H_6+C_3H_8)$ higher than 10, the deposition rate of the hydrogenated amorphous silicon layer becomes substantially slower, decreasing production efficiency. Therefore, the ratio below 10 is desirable to be used in practice. Curve C is taken for reference with hydrogenated amorphous silicon carbide layer formed with a prior art technology employing a gaseous mixture of silane ($SiH_4$) gas and methane ($CH_4$) gas with mixing ratio of 0.1 to 0.9.

The relation between mixing ratio of gaseous mixture and resistivity of the formed hydrogenated amorphous silicon carbide layer is the same as that of the first embodiment as shown in FIG. 6.

Table 2 indicates evaluation results for various specimens of the second embodiment. The experiments and the evaluation standards are the same as those of the first embodiment. Comparing both results tabulated in Table 1 and Table 2 with each other, the hydrogenated amorphous silicon carbide layer of the second embodiment shows somewhat superior characteristics to that of the first embodiment. It is concluded that the mixing ratio of propane to disilane expressed as $C_3H_8/(Si_2H_6+C_3H_8)$ ranging from 0.2 to 0.7, and the mixing ratio of hydrogen to the total of other gases $H_2/(Si_2H_6+C_3H_8)$, ranging from 1 to 10 is the best selection for glow discharge CVD to form a hydrogenated amorphous silicon carbide top layer.

TABLE 2

| sample No. | 1 | 2 | 3 | 4 | 5 | 6 | 7 | 8 | 9 |
|---|---|---|---|---|---|---|---|---|---|
| gas mixing ratio | 0.1 | 0.2 | 0.3 | 0.4 | 0.5 | 0.6 | 0.7 | 0.8 | 0.9 |
| printing quality | | | | | | | | | |
| 40% RH | Δ | ○ | ◎ | ◎ | ◎ | ◎ | ◎ | ○ | Δ |
| 50% RH | Δ | ○ | ◎ | ◎ | ◎ | ◎ | ◎ | ○ | Δ |
| 60% RH | Δ | ○ | ◎ | ◎ | ◎ | ◎ | ◎ | ○ | Δ |
| 70% RH | Δ | ○ | ◎ | ◎ | ◎ | ◎ | ◎ | Δ | Δ |
| 80% RH | Δ | ○ | ◎ | ◎ | ◎ | ◎ | ◎ | X | X |
| 90% RH | X | Δ | ○ | ○ | ○ | ○ | Δ | X | X |

Figure 11:
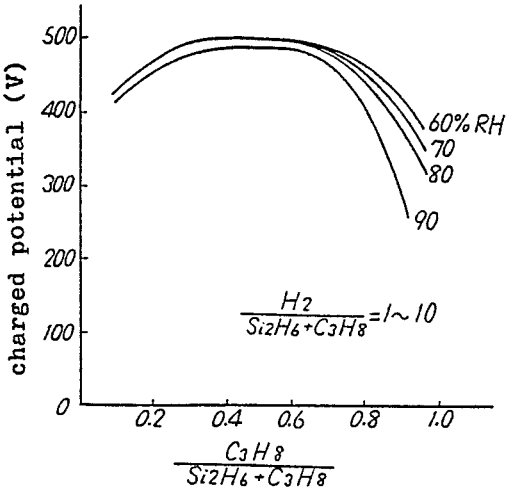
FIG. 11 is a diagram illustrating the empirical results of moisture durability with respect to the second embodiment. On the abscissa, mixing gas ratio of propane ($C_3H_8$) to disilane ($Si_2H_6$) is taken, and charged potential of the surface of the associated specimen is plotted on the ordinate.

FIG. 11 is a diagram illustrating the empirical result of moisture durability with respect to the second embodiment under the condition of room temperature 35° C. and charging voltage of 5.5 Kv. Comparing with the result of the first embodiment in FIG. 7, the durability of the second embodiment is on almost the same level of that of the first embodiment.

The present invention may be embodied in other specific forms without departing from the spirit thereof. The presently disclosed embodiments, therefore, to be considered in all respects as illistrative and not restrictive, the scope of the invention being indicated by the appended claims, rather than the foregoing description, and all changes which come within the meanind and range of equivalency of the claims are, therefore, to be embraced therein.

What we claim are:

1. An electrophotographic multi-layered photosensitive member formed on a substrate, said member having a top layer formed atop of said photosensitive member, said top layer being formed of hydrogenated amorphous silicon carbide which has an atomic ratio of carbon to silicon expressed as $C/(Si+C)$ ranging from 0.17 to 0.40 and a ratio of the number of hydrogen atoms bonded to a silicon atom per silicon atom to number of hydrogen atoms bonded to a carbon atom per carbon atom, $\{(Si—H)/Si\}/\{(C—H)/C\}$, ranging from 0.3 to 1.0, wherein C and Si designate the number of carbon atoms and the number of silicon atoms respectively and (Si—H) and (C—H) designate the number of hydrogen atoms bonded to a silicon atom and the number of hydrogen atoms bonded to a carbon atom respectively.

2. An electrophotographic multi-layered photosensitive member formed on a substrate according to claim 1, wherein said substrate is a cylindrical printing drum of electrically conductive material.

3. An electrophotographic multi-layered photosensitive member according to claim 1, wherein said photosensitive member includes a photoconductive layer formed of hydrogenated amorphous silicon (a-Si:H), and said top layer is formed over said photoconductive layer.

4. An electrophotographic multi-layered photosensitive member according to claim 3, wherein said top layer of hydrogenated amorphous silicon carbide (a-SiC:H) and said photoconductive layer of hydrogenated amorphous silicon (a-Si:H) are formed by a glow discharge CVD (chemical vapor deposition) method.

5. A method for fabricating a top layer atop of an electrophotographic multi-layered photosensitive member, comprising the steps of:

evacuating a vacuum tight chamber in which a photosensitive member formed on a substrate is disposed in a predetermined position;

introducing a gaseous mixture into said vacuum tight chamber, said gaseous mixture comprising disilane ($Si_2H_6$) gas and propane ($C_3H_8$) gas, and having a mixing mol ratio $C_3H_8/(Si_2H_6+C_3H_8)$ 0.2 and 0.6, wherein $C_3H_8$ and $Si_2H_6$ designate the number of disilane molecules and propane molecules respectively; and decomposing said gaseous mixture, and depositing a resulting material over said photosenitive member to form a top layer of hydrogenated amorphous silicon carbide (a-SiC:H) thereon.

6. A method for fabricating a top layer atop of an electrophotographic multi-layered photosensitive member, comprising the steps of:

evacuating a vacuum tight chamber in which a photosensitive member formed on a substrate is disposed in a predetermined position;

introducing a first gaseous mixture containing a silicon component and an hydrogen component into said vacuum tight chamber;

decomposing said first gaseous mixture and depositing an hydrogenated amorphous silicon photoconductive layer on said substrate;

evacuating said first gaseous mixture remaining in said vacuum tight chamber;

introducing a second gaseous mixture into said vacuum tight chamber, said second gaseous mixture comprising disilane ($Si_2H_6$) gas and propane ($C_3H_8$) gas, and having a mixing mol ratio expressed as $C_3H_8/(Si_2H_6+C_3H_8)$ between 0.2 and 0.6, wherein $C_3H_8$ and $Si_2H_6$ designate the number of disilane molecules and propane molecules respectively; and decomposing and depositing said second gaseous mixture, to form said top layer of hydrogenated amorphous silicon carbide (a-SiC:H) over said photoconductive layer.

7. A method for fabricating a top layer atop an electrophotographic multi-layered photosensitive member formed on a substrate, comprising the steps of:

evacuating a vacum tight chamber in which a photosensitive member formed on a substrate is disposed in a predetermined position;

introducing a gaseous mixture into said vacuum tight chamber, said gaseous mixture comprising disilane ($Si_2H_6$) gas and propane ($C_3H_8$) gas, and hydrogen ($H_2$) gas, and having a mixing mol ratio of said propane gas to said disilane gas expressed as $C_3(Si_2H_6+C_3H_8)$ between 0.2 and 0.7, and a mixing mol ratio of said hydrogen gas to the total of said disilane gas and said propane gas $H_2/(Si_2H_6+C_3H_8)$, between 1 and 10, wherein $C_3H_8$, $Si_2H_6$ and $H_2$ designate the number of propane molecules, disilane molecules, and hydrogen molecules respectively.

8. A method for fabricating an electrophotographic multi-layered photosensitive member formed on a substrate, comprising the steps of:

evacuating a vacuum tight chamber in which said substrate is disposed in a predetermined position;

introducing a first gaseous mixture containing a silicon component and a hydrogen component into said vacuum tight chamber;

decomposing said first gaseous mixture and depositing a hydrogenated amorphous silicon photoconductive layer over said substrate;

decomposing and depositing a second gaseous mixture, said second gaseous mixture comprising disilane ($Si_2H_6$) gas, propane ($C_3H_8$) gas, and hydrogen gas, having a mixing mol ratio of said propane gas to said disilane gas expressed as $C_3H_8/(Si_2H_6+C_3H_8)$ between 0.2 and 0.7, and a mixing mol ratio of said hydrogen gas to the total of said disilane gas and said propane gase $H_2/(Si_2H_6+C_3H_8)$, between 1 and 10, wherein $C_3H_8$, $Si_2H_6$ and $H_2$ designate the number of propane molecules, disilane molecules, and hydrogen molecules respectively, to form said top layer of hydrogenated amorphous silicon carbide (a-SiC:H) over said photoconductive layer.

9. A method for fabricating a top layer atop an electrophotographic multi-layered photosensitive member according to claims 5, 6, 7, or 8, wherein said decomposing of said gaseous mixtures is performed by a glow discharge chemical vapor deposit (CVD) method.

* * * * *